US007434616B2

(12) United States Patent
Echols

(10) Patent No.: US 7,434,616 B2
(45) Date of Patent: Oct. 14, 2008

(54) SYSTEM AND METHOD FOR FLUID CONTROL IN EXPANDABLE TUBING

(75) Inventor: Ralph H. Echols, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

(21) Appl. No.: 11/140,426

(22) Filed: May 27, 2005

(65) Prior Publication Data

US 2006/0266530 A1 Nov. 30, 2006

(51) Int. Cl.
*E21B 23/08* (2006.01)

(52) U.S. Cl. ..... 166/188; 166/387; 166/187; 166/126

(58) Field of Classification Search ..... 166/376, 166/387, 187, 126, 188
See application file for complete search history.

(56) References Cited

U.S. PATENT DOCUMENTS

| | | | | |
|---|---|---|---|---|
| 3,884,261 | A | 5/1975 | Clynch | 137/488 |
| 5,564,502 | A | 10/1996 | Crow et al. | 175/290 |
| 5,690,564 | A | 11/1997 | Hassard et al. | 473/420 |
| 6,196,261 | B1 | 3/2001 | Dennistoun | 137/527 |
| 6,394,187 | B1 | 5/2002 | Dickson et al. | 166/383 |
| 6,612,547 | B2 | 9/2003 | Carmody et al. | 251/343 |
| 6,722,427 | B2 | 4/2004 | Gano et al. | 166/217 |
| 2002/0027002 | A1 | 3/2002 | Carmody et al. | 166/66 |
| 2002/0092654 | A1 * | 7/2002 | Coronado et al. | 166/369 |
| 2003/0141059 | A1 * | 7/2003 | Mauldin et al. | 166/277 |
| 2004/0060695 | A1 | 4/2004 | Castano-Mears et al. | 166/228 |
| 2004/0256113 | A1 * | 12/2004 | LoGiudice et al. | 166/381 |
| 2005/0199401 | A1 * | 9/2005 | Patel et al. | 166/387 |
| 2006/0081401 | A1 * | 4/2006 | Miller et al. | 175/171 |

FOREIGN PATENT DOCUMENTS

| | | |
|---|---|---|
| WO | WO 98/15711 | 10/1997 |
| WO | WO 9815711 A1 * | 4/1998 |

OTHER PUBLICATIONS

European Patent Office Search Report dated Oct. 4, 2006, re European Patent Application No. 06252760 (5 pages), Oct. 4, 2006.

* cited by examiner

*Primary Examiner*—Jennifer H Gay
*Assistant Examiner*—Brad Harcourt
(74) *Attorney, Agent, or Firm*—Luke Pedersen

(57) ABSTRACT

In accordance with the teachings of the present invention, a system and method for forming a seal within tubing is provided. A section of tubing is installed in a borehole. The tubing has an inflatable element disposed along an inner surface of the tubing. The inflatable element is predisposed to expand inwardly under fluid pressure. A fluid pressure is applied to the inflatable element using a tool within the tubing, and the inflatable element is expanded to form a seal within the tubing.

22 Claims, 3 Drawing Sheets

SYSTEM AND METHOD FOR FLUID CONTROL IN EXPANDABLE TUBING

TECHNICAL FIELD OF THE INVENTION

The present invention relates in general to well completion systems, and more particularly to a system and method for fluid control in expandable tubing.

BACKGROUND OF THE INVENTION

Numerous operations are performed during the drilling and maintenance of subterranean wells that require the introduction of various fluids into the well for specific purposes. For example, fluids may be introduced into the well for the performance of gravel packing operations, sand treatment operations, or other completion or service operations. Such fluids as acids, cements, polymers, and sand-filled liquids may be injected into the formation or into the outer annulus between a sand screen and a perforated well casing. After the various operations are performed, completion fluids are introduced into the well to displace the service fluids that were used to perform the various operations.

Once the completion fluid introduction operation is complete, the apparatus used for the operation must be removed along with the tubular work string carrying the apparatus. As the apparatus is removed, however, quantities of completion fluid contained within the apparatus and work string may be lost. For example, the completion fluid may be spilt into the formation as the apparatus and work string is removed. The loss of completion fluid is undesirable since completion fluid is costly and will contaminate the formation if it is not contained.

Several methods have been developed for preventing completion fluid from being spilt into the formation. Those methods include introducing viscous pills, loss circulating material and/or gel material in the bore as the work string is withdrawn in order to protect the formation from the completion fluid. Such materials may be used to seal leak paths.

Still another method used for containing completion fluids is that of an automatically operating flapper valve. Such valves have been conventionally mounted on a screen support sub between the screen and a packer for pivotal movement from an upright, open bore position, to a horizontal, closed bore position. The flapper valve is propped open in the upright position during the various completion and service operations. When the work string and the apparatus are pulled out, the flapper valve is moved into the horizontal position against a valve seat, usually by a biasing mechanism. The closed valve keeps the completion fluid contained above the valve until another tubing string is inserted into the well.

Conventional flapper valves are generally not compatible, however, with expandable tubing, which is of a reduced diameter during installation and is expanded to an increased diameter after the tubing is in place within the borehole. In its unexpanded state, expandable tubing facilitates installation in offset, slanted, or horizontal boreholes. Upon expansion, solid or perforated tubing and screens provide support for uncased borehole walls while screening and filtering out sand and other produced solid materials which can damage the tubing. After expansion, the internal diameter of the tubing is increased, thereby improving the flow of fluids through the tubing. Because a flapper valve is typically not moved into the horizontal, or closed, position until after the tubing is expanded to the increased diameter, however, the flapper valve may not form a sufficient seal with the valve seat. As a result, a flapper valve incorporated into expandable tubing may not be effective to inhibit the loss of completion fluid.

SUMMARY OF THE INVENTION

The teachings of the present invention provide a system and method for forming a seal in a portion of expandable tubing. In accordance with a particular embodiment, the system includes a section of generally cylindrical expandable tubing. An inflatable element is disposed along an inner surface of the expandable tubing, and a tool is disposed within the expandable tubing. The inflatable element is predisposed to expand inwardly when fluid pressure is applied to the inflatable element using the tool. The inflatable element forms a seal within the expandable completion.

In accordance with another embodiment, a method for forming a seal within expandable tubing includes installing a section of expandable tubing in a borehole. The expandable tubing has an inflatable element disposed along an inner surface of the expandable tubing. The inflatable element is predisposed to expand inwardly under fluid pressure. Fluid pressure is applied to the inflatable element using a tool within the expandable tubing, and the inflatable element is expanded to form a seal within the expandable tubing.

In accordance with another embodiment, a system for removing a seal within expandable tubing is provided. The system includes a wireline operable to puncture an inflatable element when the inflatable element is in an inflated state within a section of generally cylindrical expandable tubing. The system also includes a grapple that is operable to remove the inflatable element from the expandable tubing.

Depending on the specific features implemented, particular embodiments of the present invention may exhibit some, none, or all of the following technical advantages. A technical advantage may be that a fluid-tight seal may be formed in a portion of expandable tubing. Accordingly, fluid flow within the expandable tubing may be restricted. As a result, the spillage of completion fluids and other service fluids may be reduced, and the contamination of the formation substantially prevented.

Another advantage may be that the seal may be formed from an inflatable bladder housed within the expandable tubing. Because the inflatable bladder may be selectively inflated, the fluid path in the expandable tubing may remain open during operations such as switching fluids in the open hole. When such completion operations are finished, however, the inflatable bladder may then be inflated to seal the tubing until production operations are initiated or until it is otherwise desired that the fluid flow in the expandable tubing be restored.

Other technical advantages will be readily apparent to one skilled in the art from the following figures, descriptions and claims. Moreover, while specific advantages have been enumerated above, various embodiments may include all, some or none of the enumerated advantages.

DETAILED DESCRIPTION OF THE INVENTION

Figure 1:
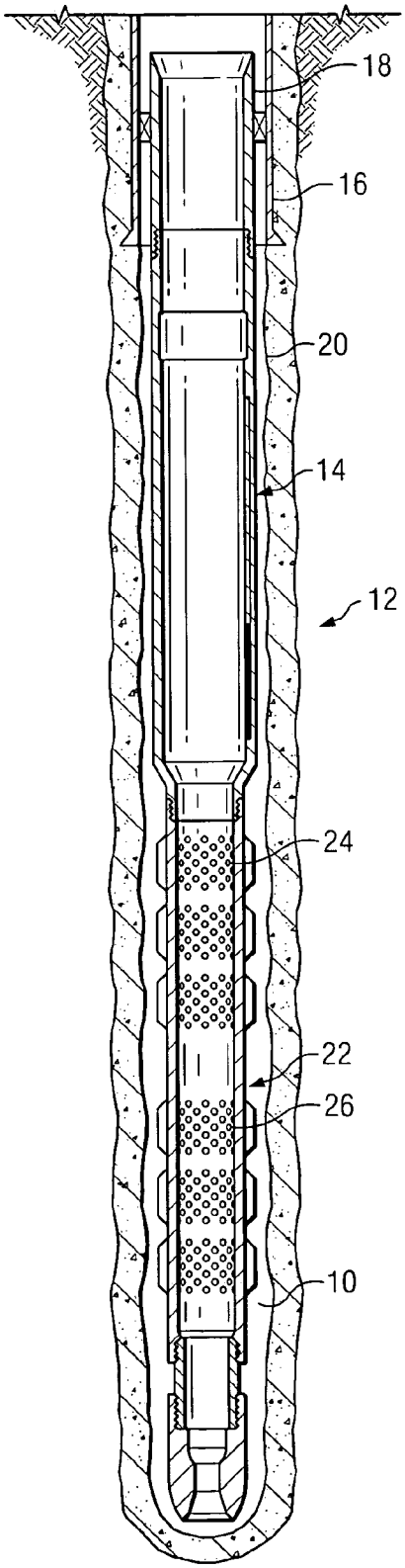
FIG. 1 illustrates a cross-sectional view of a portion of expandable tubing that includes a fluid control system in accordance with a particular embodiment of the present invention.

FIG. 1 is a cross-sectional view of a portion of a borehole 10 that includes expandable tubing 12 installed within borehole 10. In particular embodiments, expandable tubing 12 includes many mechanisms and features for performing completion, service, and production operations. One such feature includes a fluid control system 14. For purposes of this document, a "fluid control system" is a system or a combination of systems which minimize or prevent the transfer of fluids between the casing and the formation. As will be described in more detail below, fluid control system 14 may include a spacer pipe and an inflatable element disposed within a recess of the spacer pipe. In accordance with the teachings of the present invention, the expandable element includes an inflatable bladder that is actuated by fluid pressure exerted from a control line disposed within the wall of the spacer pipe. When inflated, the inflatable element is expanded across the diameter of the spacer pipe to act as a pressure bearing seal in the spacer pipe. As a result, the inflatable element may minimize or prevent the flow of fluid in the spacer pipe to minimize or prevent the draining of expensive completion fluids and other service fluids into the formation and, thus, to prevent the contamination of the formation.

In FIG. 1, borehole 10 has been drilled from the surface of the earth (not shown). An upper portion of borehole 10 has been lined with casing 16 which may be sealed to borehole 10 using cement. Casing 16 couples to a hanger 18 from which various tubing components may be hung. Below the cased portion of borehole 10 is an open hole portion 20 which extends downward through various earth formations. Although borehole 10 is illustrated as extending substantially vertically, it is generally recognized that at least a portion of open hole portion 20 may be slanted or may be substantially horizontal so that borehole 10 runs through the various earth formations at appropriate angles. Slant hole or horizontal drilling technology allows such wells to be drilled for thousands of feet away horizontally from the surface location of a well and allows a well to be guided to stay within a single zone if desired. Wells following an oil bearing zone will seldom be exactly horizontal, however, since oil bearing zones are normally not horizontal.

Tubing 12 has been placed to run from the lower end of casing 16 down through open hole portion 20 of the well. Within open hole portion 20, tubing 12 has an expandable section 22. Expandable section 22 may be a perforated liner and may typically carry sand screens or filters about its outer circumference. Expandable section 22 is illustrated as having two perforated sections 24 and 26. Although only two perforated sections 24 and 26 are illustrated, it is generally recognized that tubing 12 may extend for thousands of feet within borehole 10 and may include numerous perforated sections for controlled production from one or more zones within a formation. The term "perforated" as used in this document (e.g., perforated tubing or perforated liner) means that the member has holes or openings through it. The holes may be round, rectangular, slotted, or of any other suitable shape. "Perforated" is not intended to limit the manner in which the holes are made. For example, "perforated" does not require that the holes be made by perforating and does not limit the arrangement of the holes.

In particular embodiments, both the solid sections and perforated sections 24 and 26 of expandable section 22 may be expanded to increase the overall diameter of the section. Depending on the types of expansion required, a fixed expansion cone and/or a variable diameter expansion cone may be used to expand expandable section 22. The fixed expansion cone may be carried on an expansion tool string. Expansion may be initiated from a cone launcher disposed up hole from expansion section 22. The fixed expansion cone may be used to expand the entire tubing string down hole of the expansion launcher as the tool is run down borehole 10. Where additional expansion is desired at particular locations in tubing 12, an adjustable cone may be carried on the expansion tool string in addition to the fixed cone. Alternatively, an adjustable cone may be carried down hole with tubing 12 as tubing 12 is installed and picked up by the expansion tool when the cone reaches the end of tubing 12.

The use of expandable tubing 12 provides numerous advantages. For example, expandable tubing 12 is of a reduced diameter during installation, which facilitates installation through relatively small diameter sections uphole from the desired location of the expandable tubing, and in offset, slanted, or horizontal boreholes. Upon expansion, expansion sections 22 and screens disposed on the outer diameter of expansion sections 22 provide support for uncased borehole walls while screening and filtering out sand and other produced solid materials which can damage expandable tubing 12. After expansion, the internal diameter of expansion sections 22 is increased improving the flow of fluids through expandable tubing 12.

It is desirable for expandable tubing 12 to reduce the annulus between expandable tubing 12 and the borehole wall as much as possible. Expandable tubing 12 may be expanded only a limited amount, however, without rupturing. It is therefore desirable for expandable tubing 12 to have the largest possible diameter in its unexpanded condition as expandable tubing 12 is run into the borehole. That is, the larger expandable tubing 12 is before expansion, the larger expandable tubing 12 may be after expansion. Elements carried on the outer surface of expandable tubing 12 as it is run into borehole 10 increase the outer diameter of the string. The total outer diameter must be sized to allow the string to be run into borehole 10. The total diameter is the sum of the diameter of the actual tubing 12 plus the thickness or radial dimension of any external elements. Thus, external elements effectively reduce the allowable diameter of the expandable tubing 12 itself.

Figure 2:
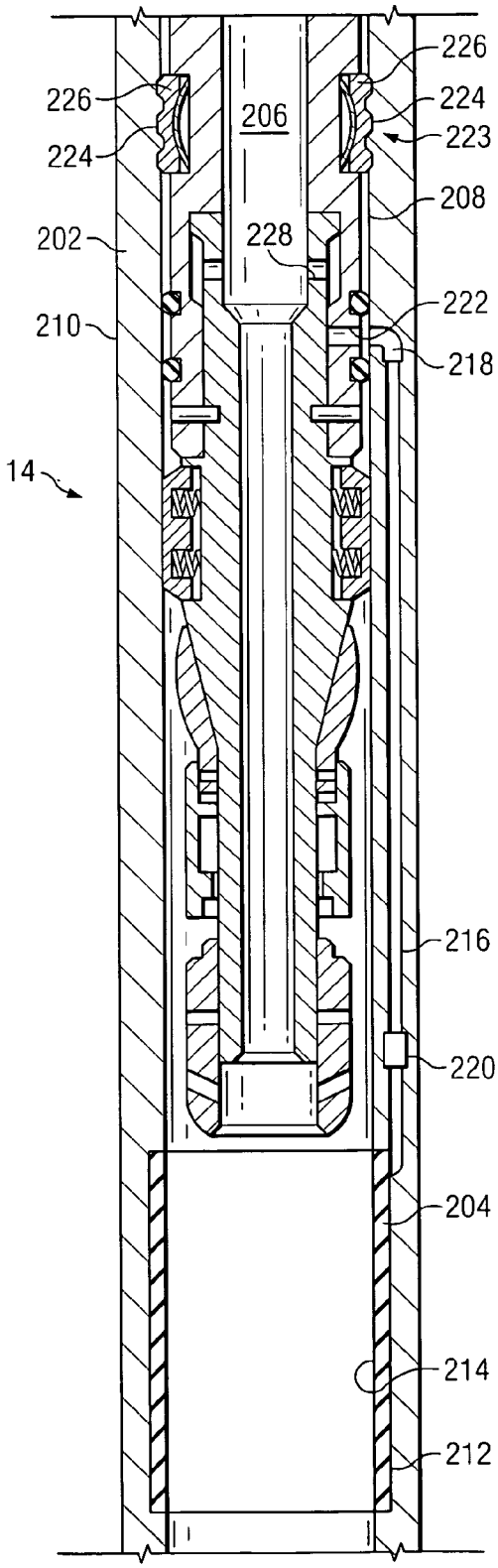
FIG. 2 illustrates a cross-sectional view of a fluid control system that includes an inflatable element for preventing the flow of fluid in an open hole completion in accordance with a particular embodiment of the present invention.

FIG. 2 illustrates a cross-sectional view of fluid control system 14. As described above, fluid control system 14 comprises a portion of expandable tubing positioned within borehole 10. According to an embodiment of the present invention, fluid control system 14 includes a spacer pipe 202 and an inflatable element 204. In particular embodiments, fluid control system 14 is up hole of an expandable portion of the tubing, such as expandable portion 22 of expandable tubing 12. After an expansion tool 206 is used to expand the expandable portions of the tubing, the expansion tool 206 may be backed up the borehole until all or a substantial portion of expansion tool 206 is positioned within spacer pipe 202.

Inflatable element 204 may then be inflated to seal off a down hole portion of the expandable tubing to prevent the flow of fluid in spacer pipe 202.

In the illustrated embodiment, spacer pipe 202 comprises a wall that has an inner surface 208, which defines the inner diameter of spacer pipe 202, and an outer surface 210, which defines the outer diameter of spacer pipe 202. Inner surface 208 includes a recess 212 formed around at least a portion of the circumference of inner surface 208. Recess 212 is configured to house inflatable element 204. Accordingly, recess 212 may be configured to accommodate any appropriate size and shape for housing inflatable element 204. In particular embodiments, recess 212 is sized such that an inner surface 214 of inflatable element 204 is substantially flush with inner surface 208 of spacer pipe 202 when inflatable element 204 is in a non-inflated state.

Figure 4:
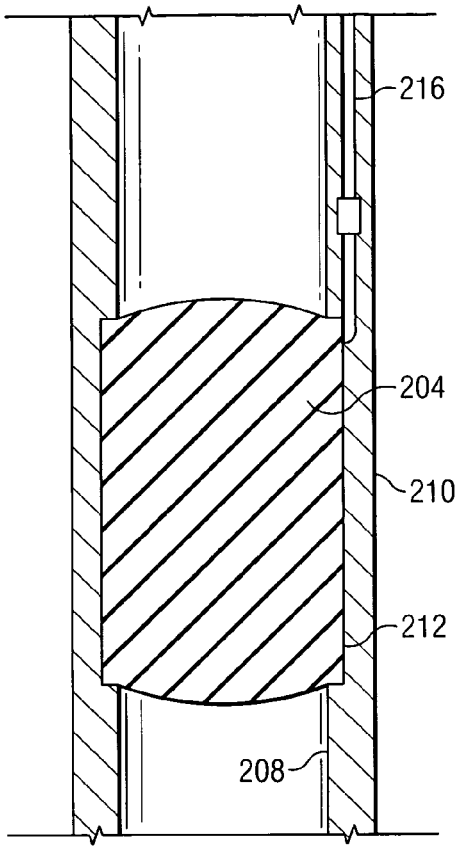
FIG. 4 illustrates one example embodiment of an inflatable element of the fluid control system of FIG. 2.

In particular embodiments, inflatable element 204 comprises an elongate, longitudinal bladder that is installed within recess 212. Inflatable element 204 forms a fluid chamber that may be selectively actuated, or inflated, to form a fluid-tight seal between an up hole portion of the tubing and a down hole portion of the tubing (illustrated in FIG. 4). In the inflated state, the fluid chamber formed by inflatable element 204 may be filled with a fluid, which may include any type of liquid, gas, or liquid like solid that inflates inflatable element 204 to form a seal in spacer pipe 202. In particular embodiments, the fluid in inflatable element 204 may include water, brine, completion fluids, or other types of service fluids injected into the borehole through an interior passage conduit within expansion tool 206 prior to production operations.

For receiving the completion or other fluids in inflatable element 204 and for actuating inflatable element 204, spacer pipe 202 is configured to include a control line 216 disposed within the wall of spacer pipe 202. Stated differently, fluid is received in inflatable element 204 from control line 216 located between inner surface 208 and outer surface 210. Accordingly, a first down hole end of control line 216 is in fluid communication with inflatable element 204 and provides a conduit through which completion fluid or another service fluid may be passed from control line 216 and into inflatable element 204.

For receiving fluid to be transferred to inflatable element 204, a second end of control line 216 includes a fluid port 218. Fluid enters control line 216 through fluid port 218 and is then transported through control line 216 to inflatable element 204. For the selective control of fluid, however, control line 216 may include a check valve 220 in particular embodiments. Thus, fluid may pass freely through check valve 220 in a downhole direction. However, check valve 220 prevents passing of fluid through control line 216 in an uphole direction to prevent backflow of the fluid contained in inflatable element 204. Accordingly, check valve 220 may be used to maintain the pressure of fluid within inflatable element 204. In particular embodiments, check valve 220 may not only help to contain the fluid or other material within the fluid chamber defined by inflatable element 204, but also allow for the selective and partial release of fluid from inflatable element 204, to alleviate excessive pressure therein.

As described above, expansion tool 206 operates as the source of fluid or other material for actuating inflatable element 204. Accordingly, expansion tool 206 cooperates with fluid port 218 to provide fluid to control line 216. As described above, expansion tool 206 is backed up the borehole after the expansion process until expansion tool 206 is properly positioned within spacer pipe 202. In particular embodiments, expansion tool 206 may be properly positioned relative to spacer pipe 202 when an outer fluid port 222 of expansion tool 206 substantially aligns with fluid port 218 of spacer pipe 202. As will be described in more detail below, outer fluid port 222 provides a portion of the conduit through which fluid may be transferred from expansion tool 206 to control line 216.

For the proper alignment of expansion tool 206 and spacer pipe 202, spacer pipe 202 includes a latch-type mechanism 223 of the type that are commonly known in the art for locking two tool components together. In the illustrated embodiment, latch-type mechanism 223 includes a locating profile 224 on the inner surface 208 of spacer pipe 202. Locating profile 224 cooperates with a corresponding key 226 on the outer surface of expansion tool 206 to lock expansion tool 206 to spacer pipe 202 in the desired position. For example, locating profile 224 of spacer pipe 202 may include a series of notches and projections, which are generally opposite to a series of notches and projections on key 226 of expansion tool 206. In particular embodiments, latch-type mechanism 223 may be spring loaded such that when the corresponding notches and projections are engaged, a force is applied by latch-type mechanism 223 to hold the corresponding notches and projections in their cooperative position.

Figure 3A:
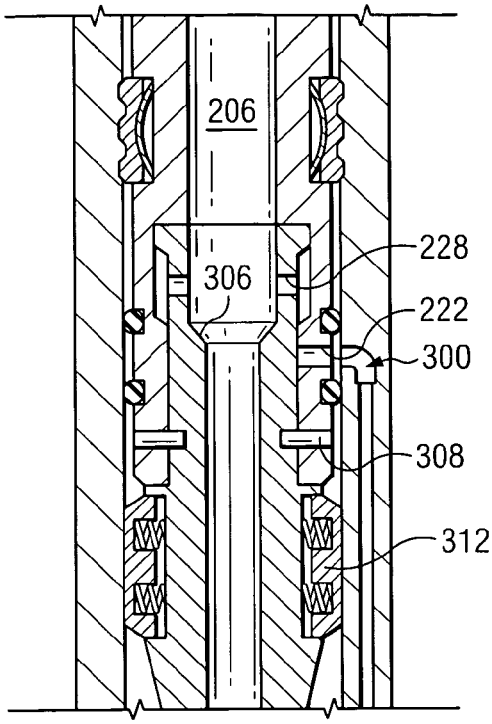
FIGS. 3A and 3B illustrate cross-sectional views of a fluid passage of the fluid control system of FIG. 2, in closed and open positions, respectively.

As described above, when expansion tool 206 is locked into the proper position relative to spacer pipe 202, outer fluid port 222 of expansion tool 206 may be substantially aligned with fluid port 218 of spacer pipe 202. In the initial locked-in position of expansion tool 206, however, fluid may be prevented from being transferred from expansion tool 206 to control line 216 by a misaligned inner fluid port 228 of expansion tool 206. Thus, the fluid passage formed by inner fluid port 228 and outer fluid port 222 may be said to be "closed" in the initial locked-in position of expansion tool 206. FIG. 3A provides an expanded view of a fluid passage 300 formed by inner fluid port 228 and outer fluid port 222 in the closed position. The closed position of fluid passage 300 allows fluid to be transferred through expansion tool 206 for the performance of completion and service operations.

Figure 3B:
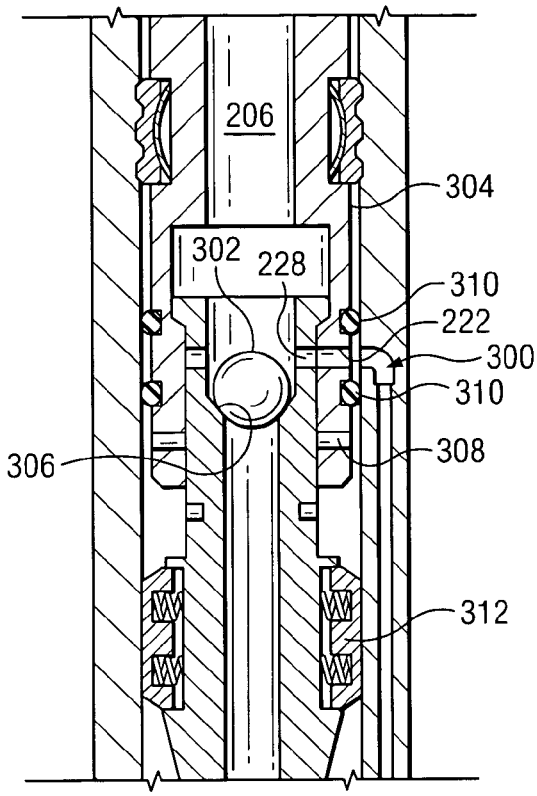

After the performance of gravel packing, sand treatment, or other completion operations, it may be desirable to seal off spacer pipe 202 to maintain the pressure of fluid in the spacer pipe 202. Accordingly, fluid passage 300 may be "opened." FIG. 3B illustrates an expanded view of the fluid passage 300 formed by inner fluid port 228 and outer fluid port 222 in the open position. In particular embodiments, a ball 302 may be dropped down the interior passage 304 of expansion tool 206 to transition fluid passage 300 from the closed position to the open position. Ball 302 may pass through interior passage 304 of expansion tool 206 until it reaches shoulder 306. Shoulder 306 may provide a transition from a wider portion of interior passage 304 to a narrower portion of interior passage 304. Ball 302 may become lodged against shoulder 306 or otherwise collaborate with shoulder 306 to result in the blockage of interior passage 304.

After the blockage of interior passage 304, additional fluid that is pumped through the up hole portion of interior passage 304 causes a buildup in pressure in the portion of interior passage 304 that is up hole of ball 302. When the pressure reaches a predetermined level, a shear pin 308 may react to the pressure by shearing. The shearing of shear pin 308 may release a portion of expansion tool 206 from a fixed position. As a result, a portion of expansion tool 206 that includes inner passage 228 may movably slide or otherwise be displaced relative to a portion of expansion tool 206 that includes outer passage 222. The movement of the portion of expansion tool 206 that includes inner passage 228 may result in the alignment of inner passage 228 with outer passage 222 and, thus, the "opening" of fluid passage 300. Fluid within the portion of interior passage 304 may then pass through fluid passage 300 and port 218 and into control line 216, which feeds into inflatable element 204. In this manner, inflatable element 204 may be inflated with fluid to form a fluid-tight seal between an up hole portion of the tubing (illustrated in FIG. 4), which includes expansion tool 206, and a down hole portion of the tubing.

To prevent fluid loss into the space between expansion tool 206 and spacer pipe 202, expansion tool 206 includes a pair of seals 310. A seal 310 is disposed on both sides (up hole and down hole) of fluid passage 310 on the exterior of expansion tool 206. In particular embodiments, seals 310 may be configured like and operate similar to baffle cups. When expansion tool 206 is in the locked in position relative to spacer pipe 202, seals 310 may form a fluid-tight seal between expansion tool 206 and spacer pipe 202. As a result, when fluid passes from fluid passage 300 of expansion tool 206 to fluid port 218 of spacer pipe 202, fluid may be prevented from spilling into the space between expansion tool 206 and spacer pipe 202.

Various systems and methods may be used to inflate the inflatable elements illustrated and described within this specification. For example, in lieu of the tool described above, the inflatable element(s) may be inflated remotely via annular pressure, or a control line, for example. It should be recognized by those of ordinary skill in the art that many methods, systems and configurations may be employed to introduce sufficient pressure to the inflatable element, to cause expansion of the inflatable element.

As illustrated in FIGS. 3A and 3B, expansion tool 206 may also include a drag block 312 at least partially disposed on the outer surface of expansion tool 206. Drag block 312 may include a mechanical component that extends from the outer surface of expansion tool 206 a sufficient distance to protect seals 310 and components of fluid passage 300 as expansion tool 206 is manipulated within the spacer pipe 202 and other portions of expandable tubing 12. In particular embodiments, drag block 312 may also operate to stabilize expansion tool 206 against spacer pipe 202 and other portions of expandable tubing 12 as various completion and service operations are being performed in well bore 10.

The expandable element described herein may be used to form a complete or partial seal in almost any configuration of tubing or other components of a well bore. In accordance with an alternative embodiment of the present invention, an expandable element of the type illustrated herein may be used to form an annular seal between two sections of tubing of the well bore. For example, in accordance with one embodiment, a second section of tubing may be disposed within a larger section of tubing, creating a flow path between the two sections of tubing. In this embodiment, the expandable element may be disposed between the two sections of tubing, to form a seal between the two sections of tubing when the expandable element is expanded.

Figure 5A:
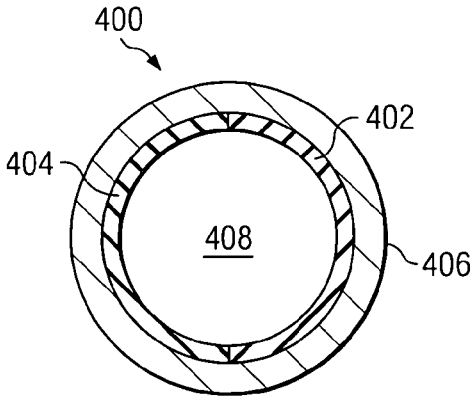
FIGS. 5A and 5B illustrate cross-sectional views of another example embodiment of an inflatable element of the fluid control system of FIG. 2.
Figure 5B:
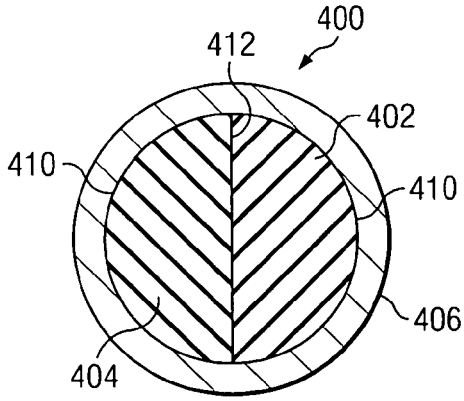

FIGS. 5A and 5B illustrate cross-sectional views of another example embodiment of inflatable element 400 of fluid control system 14. Specifically, FIG. 5A illustrates an example embodiment of an inflatable element 400 in a non-inflated state, and FIG. 5B illustrates inflatable element 400 in an inflated state. In the illustrated embodiment, inflatable element 400 includes a first portion 402 and a second portion 404. First and second portions 402 and 404 may form two halves of an inflatable element 400.

In the non-inflated state, first and second portions 402 and 404 form a substantially continuous inflatable liner within a spacer pipe 406. In particular embodiments, spacer pipe 406 may be configured similar to and operate like spacer pipe 202 of FIGS. 2, 3A, and 3B. Accordingly, in particular embodiments first and second portions 402 and 404 may be disposed within a recess of spacer pipe 406 to provide an interior passage 408 within spacer pipe 406. Interior passage 408 provides space for the running of expansion tool 206 and other completion and production tools.

First and second portions 402 and 404 may each be coupled to a control line that is substantially similar to control line 216 of FIG. 2. Accordingly, first and second portions 402 and 404 may be inflated in a manner that is similar to that described with regard to FIGS. 3A and 3B. Upon inflation, first and second portions may be filled with a fluid provided from an expansion tool positioned within spacer pipe 406. As is illustrated in FIG. 5B, first and second portions 402 and 404 inflate to eliminate interior passage 408 to prevent the flow of fluid down hole of inflatable element 400. As a result, the loss of completion fluids and contamination of the formation may be prevented. In an alternative embodiment, first and second portions 402 and 404 may be coupled with independent control lines. Accordingly, first and second portions 402 and 404 may also be inflated independently where desired.

To prevent fluid loss, first and second portions 402 and 404 are configured in a manner that forms a fluid-tight seal when inflated. In the illustrated embodiment, each of first and second portions 402 and 404 are in the shape of a half circle. Thus, each of first and second portions 402 and 404 include a substantially spherical surface 410 and a substantially planar surface 412. When inflated, substantially planar surface 412 of first portion 402 contacts substantially planar surface 412 of second portion 404 to form a fluid-tight seal with one another. Because first and second portions 402 and 404 cooperate to form a fluid-tight seal, inflatable element 400 forms a fluid tight seal within spacer pipe 406 and the flow of fluid up hole and down hole of spacer pipe 406 is prevented.

Figure 6:
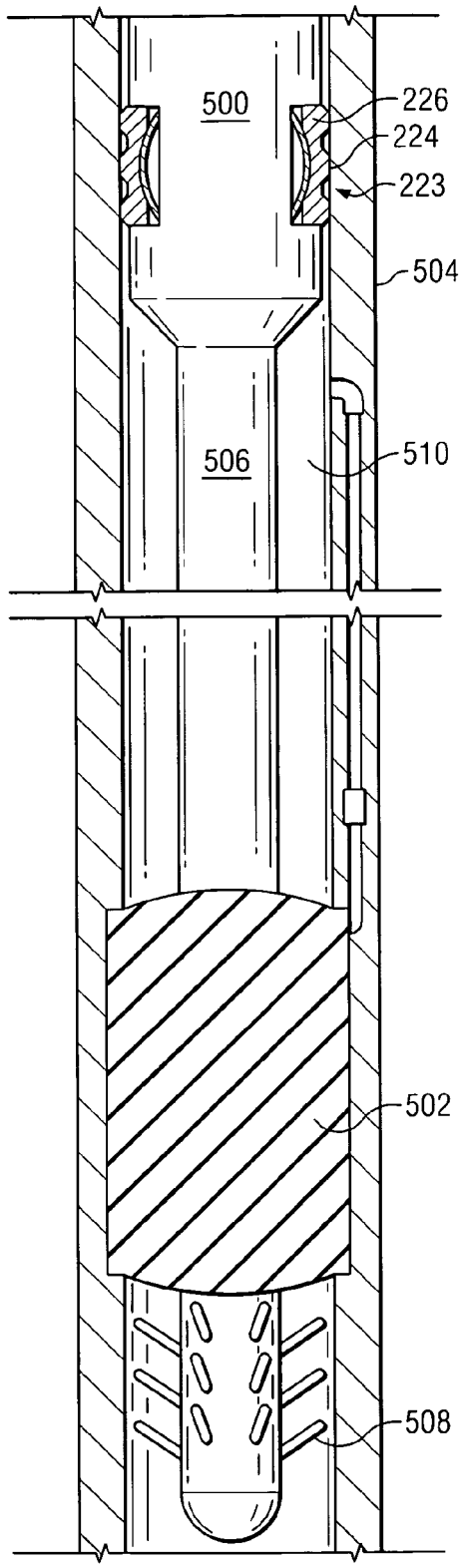
FIG. 6 illustrates a cross-sectional view of a retrieval system for removing an inflatable element of the fluid control system of FIG. 2.

FIG. 6 illustrates a cross-sectional view of a retrieval system 500 for removing an inflatable element 502 within a spacer pipe 504. Inflatable element 502 and spacer pipe 504 may be configured similar to and operate like inflatable element 204 and spacer pipe 202 of FIG. 2, respectively. In the illustrated embodiment, retrieval system 500 includes a wireline tool 506 with a grapple 508 for removing inflatable element 502.

Specifically, it may be desirable to remove inflatable element 502 to clear the interior passage 510 defined by spacer pipe 504 for the performance of production operations. Accordingly, prior to the commencement of production operations, retrieval system 500 may be ran down spacer pipe 504 within the borehole until retrieval system 500 is properly positioned within spacer pipe 504. In particular embodiments, retrieval system 500 may be locked to spacer pipe 504 using a latch-type mechanism of the type that is commonly known in the art for locking two elements together. In particular embodiments, the latch-type mechanism may be configured like and operate similar to the latch-type mechanism described above with regard to FIG. 2. Accordingly, in particular embodiments, a locating profile 514 on the inner surface of spacer pipe 504 cooperates with a corresponding key 516 on the outer surface of wireline tool 506 to wireline tool 506 to spacer pipe 504.

After retrieval system 500 is properly positioned in and locked to spacer pipe 504, grapple 508 may be ran through inflatable element 502 from an up hole end of inflatable element 502 to a down hole end of inflatable element 502. When run through inflatable element 502, grapple 508 may pierce inflatable element 502 and release fluid contained within the fluid chamber defined by inflatable element 502 into interior passage 510. As a result, inflatable element 502 may be returned to an non-inflated state. To remove inflatable element 502 from spacer pipe 504, the latch-type mechanism locking retrieval system 500 to spacer pipe 504 may be disengaged. Retrieval system 500 may be backed-up the borehole and removed from spacer pipe 504. As retrieval system 500 is backed up the borehole, inflatable element 502 may be caught on grapple 508 and carried on retrieval system 500. In this manner, inflatable element 502 may be removed from spacer pipe 504 such that interior passage 510 is substantially cleared for production and other operations.

Although retrieval system 500 is described as including a wireline and grapple configuration, it is generally recognized that other configurations of retrieval system 500 and/or methods may be used to remove inflatable element 502. For example, in lieu of the wireline and grapple configuration, a chemical cut tool on an electric line may be used to pierce inflatable element 502. In particular embodiments, the chemical cut tool may be positioned in spacer pipe 504 similar to the positioning of the wireline and grapple configuration. An electric current may then be provided to activate chemicals inside the chemical cut tool. The chemicals may result in the at least partial dissolution of inflatable element 502. Where desired, a grapple might then be used to remove any remaining bits of inflatable element 502. Various other methods, systems and tool configurations are also available for the removal of the inflatable element, in accordance with the teachings of the present invention.

Returning generally to FIGS. 1-6, the systems described exhibit several advantages. For example, a technical advantage may be that a fluid-tight seal may be formed in a portion of expandable tubing. Accordingly, fluid flow within the expandable tubing may be restricted. As a result, the spillage of completion fluids and other service fluids may be reduced, and the contamination of the formation substantially prevented.

Another advantage may be that the seal may be formed from an inflatable bladder housed within the expandable tubing. Because the inflatable bladder may be selectively inflated, the fluid path in the expandable tubing may remain open during sand treatment, gravel packing, and other completion operations. When such completion operations are finished, however, the inflatable bladder may then be inflated to seal the tubing until production operations are initiated or until it is otherwise desired that the fluid flow in the expandable tubing be restored.

Although the present invention has been described in several embodiments, a myriad of changes, variations, alterations, transformations, and modifications may be suggested to one skilled in the art, and it is intended that the present invention encompass such changes, variations, alterations, transformations, and modifications as falling within the spirit and scope of the appended claims. For example, many of the above-described embodiments include the use of an expansion cone type of device for expansion of the tubing. However, one of skill in the art will recognize that many of the same advantages may be gained by using other types of expansion tools such as fluid powered expandable bladders or packers.

As another example, although many of the embodiments illustrated and described herein include expandable completion systems, the teachings of the present invention are also applicable to non-expandable completion systems, for example, sand control completions with non-expanded screens.

As yet another example, although many of the embodiments illustrated and described herein include the inflatable element embedded in the wall of a spacer pipe, the inflatable element could also be embedded in a well casing. In this embodiment, the inflatable element could be activated during a separate trip of the work string.

As another example, in many of the above described embodiments, the system is illustrated using an expansion tool which travels down hole as it expands expandable tubing and then is partially retracted to deploy a fluid control system. Each of these systems may operate equally well with an expansion tool which travels up hole during the tubing expansion process. In some embodiments, the locations of various latch-type mechanisms, seals, ports, drag blocks, and check valves may be changed if the direction of travel of the expansion tool is changed. For horizontal boreholes, the term up hole means in the direction of the surface location of a well.

Similarly, while many of the specific preferred embodiments herein have been described with reference to use in open boreholes, similar advantages may be obtained by using the methods and structures described herein to form annular isolators between tubing and casing in cased boreholes. Many of the same methods and approaches may also be used to advantage with production tubing which is not expanded after installation in a borehole, especially in cased wells.

What is claimed is:

1. A system for forming a seal within tubing, comprising:

a section of generally cylindrical production tubing, wherein the production tubing is moveable through a casing;

an inflatable element disposed along an inner surface of an expandable portion of the cylindrical production tubing;

the inflatable element being predisposed to expand inwardly when fluid pressure is applied to the inflatable element, the inflatable element forming a seal within the cylindrical production tubing when expanded;

a tool disposed within the cylindrical production tubing; and wherein the fluid pressure is applied to the inflatable element using the tool.

2. The system of claim 1, wherein the cylindrical tubing comprises a spacer pipe and at least one section of expandable perforated tubing.

3. The system of claim 2, wherein the tool comprises an expansion tool operable to expand at least a portion of the cylindrical tubing.

4. The system of claim 1, wherein the cylindrical tubing includes a recess formed in the inner surface of the cylindrical tubing, the inflatable element being disposed in the recess.

5. The system of claim 1, wherein:

the cylindrical tubing comprises a control line that at least partially couples the inflatable element and the tool for fluid communication; and the control line comprises a fluid port operable to receive fluid from the tool.

6. The system of claim 1, wherein the inflatable element comprises a first portion and a second portion, the first and second portions defining independent fluid chambers and being disposed on opposing sides of the cylindrical tubing, the first and second portions operable to form a fluid-tight seal in response to fluid pressure.

7. The system of claim 1, wherein a fluid port of the cylindrical tubing is substantially aligned with at least a portion of a fluid passage of the tool when the tool is locked to the cylindrical tubing.

8. The system of claim 1, wherein the tool comprises a shear pin that is operable to shear under fluid pressure to move a first portion of the tool relative to a second portion of the tool, the first portion comprising an inner port coupled to an interior passage of the tool, the interior passage operable to transport a fluid through the tool, the second portion comprising an outer port that is selectively aligned with the inner port to form a fluid passage coupling the interior passage to a port of the cylindrical tubing.

9. The system of claim 1, further comprising a retrieval system operable to remove the inflatable element from the cylindrical tubing when the inflatable element is in an inflated state, the retrieval system comprising:

a chemical tool that stores a chemical operable to at least partially dissolve the inflatable element when activated; and an electric line operable to transfer an electrical current to the chemical tool to activate the chemical.

10. The system of claim 1, wherein the section of generally cylindrical tubing comprises a first section of generally cylindrical tubing, and further comprising:

a second section of generally cylindrical tubing disposed within the first section of generally cylindrical tubing; and wherein the inflatable element is disposed between the first and second sections of generally cylindrical tubing.

11. The system of claim 1, further comprising a sand screen element disposed along an outer surface of the expandable portion of the cylindrical production tubing.

12. A method for forming a seal within tubing, comprising:

moving a section of generally cylindrical production tubing through a casing;

installing the section of generally cylindrical production tubing in a borehole, the cylindrical production tubing having an inflatable element disposed along an inner surface of an expandable portion of the cylindrical production tubing, the inflatable element being predisposed to expand inwardly under fluid pressure;

expanding the expandable portion of the cylindrical production tubing;

applying fluid pressure to the inflatable element;

expanding the inflatable element to form a seal within the cylindrical production tubing; and a tool being disposed within the cylindrical production tubing, and wherein the fluid pressure is applied to the inflatable element using the tool.

13. The method of claim 12, wherein installing the section of cylindrical tubing in the borehole comprises installing a spacer pipe and at least one section of expandable perforated tubing.

14. The method of claim 13, further comprising using the tool to expand at least a portion of the cylindrical tubing.

15. The method of claim 12, further comprising:

providing a control line within a wall of the cylindrical tubing to at least partially couple the inflatable element and the tool for fluid communication; and providing a fluid port operable to receive fluid from the tool and transport the fluid to the control line.

16. The method of claim 12, wherein expanding the inflatable element comprises:

expanding a first independent fluid chamber portion of the inflatable element in response to fluid pressure;

expanding a second independent fluid chamber portion of the inflatable element in response to fluid pressure; and forming a fluid-tight seal using the first and second independent fluid chamber portions.

17. The method of claim 12, further comprising:

aligning a locating profile of the cylindrical tubing with a key of the tool;

aligning a fluid port of the cylindrical tubing with at least a portion of a fluid passage of the tool; and locking the tool to the cylindrical tubing by engaging the key with the locating profile.

18. The method of claim 12, further comprising:

using fluid pressure to shear a shear pin to move a first portion of the tool relative to a second portion of the tool;

aligning an inner port of the first portion with an outer port of the second portion; and forming a fluid passage coupling an interior passage to a port of the cylindrical tubing.

19. The method of claim 18, wherein deflating the inflatable element comprises puncturing the inflatable element.

20. The method of claim 18, wherein deflating the inflatable element comprises activating a chemical operable to at least partially dissolve the inflatable element.

21. The method of claim 12, further comprising:

deflating the inflatable element when the inflatable element is in an inflated state; and removing the inflatable element from the cylindrical tubing.

22. The method of claim 12, wherein the cylindrical production tubing further comprises a sand screen element disposed along an outer surface of the expandable portion of the cylindrical production tubing.

* * * * *